US005961123A

United States Patent [19]

Ingram et al.

[11] Patent Number: 5,961,123

[45] Date of Patent: Oct. 5, 1999

[54] METAL BACK-UP RING FOR DOWNHOLE SEALS

[75] Inventors: Gary Ingram, Sugar Land; Jose Barragan, Houston, both of Tex.

[73] Assignee: Baker Hughes Incorporated, Houston, Tex.

[21] Appl. No.: 08/828,768

[22] Filed: Apr. 1, 1997

Related U.S. Application Data

[60] Provisional application No. 60/014,517, Apr. 1, 1996.

[51] Int. Cl.[6] ..... F16J 15/16; F21B 33/128

[52] U.S. Cl. ..... 277/311; 277/339; 277/342

[58] Field of Search ..... 277/337, 338, 277/339, 342, 311; 166/195, 196, 203, 387

[56] References Cited

U.S. PATENT DOCUMENTS

| | | | |
|---|---|---|---|
| 2,885,009 | 5/1959 | Baker | 277/337 |
| 2,921,632 | 1/1960 | Clark, Jr. | 277/338 |
| 2,961,633 | 1/1960 | Baker | 277/338 |
| 3,358,766 | 12/1967 | Current | 277/337 |
| 3,412,790 | 11/1968 | Brown | 166/387 X |
| 3,554,280 | 1/1971 | Tucker | 277/339 X |
| 4,375,240 | 3/1983 | Baugh et al. . | |
| 4,441,559 | 4/1984 | Evans et al. . | |
| 4,753,444 | 6/1988 | Jackson et al. | 277/388 X |
| 4,791,992 | 12/1988 | Greenlee et al. . | |
| 5,390,737 | 2/1995 | Jacobi et al. | 166/387 X |
| 5,404,956 | 4/1995 | Bohlen et al. | 166/387 X |
| 5,433,269 | 7/1995 | Hendrickson . | |

*Primary Examiner*—Lynne A. Reichard
*Assistant Examiner*—David E. Bochna
*Attorney, Agent, or Firm*—Rosenblatt & Redano P.C.

[57] ABSTRACT

A sealing element for a packer or bridge plug or other downhole tool is illustrated which employs the use of back-up rings above and/or below a resilient seal. The various sleeves which are moved with respect to each other to compress the sealing element are made so that they are physically connected to the back-up rings. As a result, upon run-in, inadvertent compression of the seal is prevented and upon release, a physical separation occurs between the back-up ring and the sealing element, which allows the sealing element to expand and relax. Subsequent upward movement of the packer or bridge plug easily deflects the back-up ring since the sealing element is no longer in a compressed state directly underneath it. The packer then can easily be removed.

15 Claims, 13 Drawing Sheets

METAL BACK-UP RING FOR DOWNHOLE SEALS

This application claims the benefit of U.S. Provisional Ser. No. 60/014,517 filed Apr. 1,996.

FIELD OF THE INVENTION

The field of this invention relates to sealing techniques particularly used in packers and bridge plugs downhole.

BACKGROUND OF THE INVENTION

Downhole packers and bridge plugs have used seals which are compressed by relative movement in conjunction with setting of slips to secure the position of the packer or bridge plug. The slips are cammed outwardly against the tubing or casing to anchor the packer or bridge plug. The relative movement, which is part of the setting procedure for the bridge plug or packer, results in a longitudinal compression of the sealing element or elements, with the compressed position being retained generally through the use of body lock rings. Ultimately, when it is time to release the packer or bridge plug, the locking mechanism of the body lock rings is undermined so that the sealing element can relax, after which the slips are pulled or cammed away from the tubing or casing so that the packer or bridge plug can be retrieved to the surface. One of the problems with sealing elements of the prior designs has been that the seal material, when subjected to extremes of differential pressure, can tend to extrude uphole or downhole, depending on the direction of pressure differential. To counteract this phenomenon, metal back-up rings have been used above and below the sealing element or elements to act as extrusion barriers. The prior technique of mounting such metal back-up rings is illustrated in FIGS. 1 and 2. In FIG. 1*a*, a typical double-bore packer is illustrated, with the sealing element 10 in set position against the casing 12. The sealing element 10 is made up of several components which are squeezed together in the view shown in FIG. 1*a*. In between the components is a real separator 14. Above and below the seal assembly 10 are back-up rings 16, which have now been compressed into a generally right angle shape. One surface of the back-up ring 16 bears flush around the periphery of the seal 10 against the casing 12, while the other segment of each of the back-up rings 16 bears against, but is not mechanically connected, to, sleeves 18 or 20. It is the relative movement between sleeves 18 and 20 that compresses the sealing element 10. The back-up ring, for structural rigidity, has a body portion 22 to which the L-shaped segment is connected. by comparing FIG. 1*a* to FIG. 2*a*, it can be seen that when it is time to release the packer illustrated, the sleeve 20 has been pulled uphole away from the body portion 22 of the upper metal back-up ring 16. However, the sealing element 10 has failed to relax because the L-shaped portion of the metal back-up ring, in combination with body portion 22, is effectively wedged between the casing 12 and the body 24 of the packer P. Therefore, any further upward force to attempt to retrieve the packer P could stick the packer P in the wellbore, which could require alternate retrieval methods.

This problem occurs because the metal back-up ring structure, which after setting of the element 10 assumes an L-shaped profile in combination with the square cross-section body, is not connected to the moving sleeve 20 such that a release procedure of the packer P does not mechanically separate the back-up ring 16 from the element 10. This lack of connection between the back-up ring 16 and the sleeves 18, 20 can also create problems on insertion of the packer P into the wellbore. Those skilled in the art appreciate that the body elements which ultimately move relatively to each other to compress the seal 10 are held together for run-in. However, with the body 22 not connected to sleeve 18, downward movement of the packer P toward its ultimate setting point can create an upward or compressing force on the sealing element 10 to cause it to expand prematurely before the desired depth is reached. This can cause not only tearing and/or destruction of the sealing element before the packer P reaches its desired depth, but can also result in sticking the packer at a location before it reaches its target depth. Alternatively, sufficient damage to the sealing element 10 Upon insertion of the packer could result in a situation where, when the packer P is set, it will not hold a seal.

The object of the present invention is to provide a seal assembly which will overcome the problem illustrate din FIG. 2*a*. The objective is accomplished by physically linking a back-up ring to a movable sleeve so that at least one of the back-up rings, on relaxation of the packer, move away from the sealing element 10 to allow it room to relax. Once the back-up ring is moved away from the sealing element in a compressed state, upward movement of the packer will simply collapse the back-up ring since there is no sealing element underneath it. An additional object of the invention is to protect the sealing assembly during run-in to prevent inadvertent expansion which could not only damage the sealing element but also cause the packer to stick in the wellbore at an undesired location. Those and other objects of the invention will be readily understood by a review of the detailed description of the preferred embodiment which is below.

SUMMARY OF THE INVENTION

A sealing element for a packer or bridge plug or other downhole tool is illustrated which employs the use of back-up rings above and/or below a resilient seal. The various sleeves which are moved with respect to each other to compress the sealing element are made so that they are physically connected to the back-up rings. As a result, upon run-in, inadvertent compression of the seal is prevented and upon release, a physical separation occurs between the back-up ring and the sealing element, which allows the sealing element to expand and relax. Subsequent upward movement of the packer or bridge plug easily deflects the back-up ring since the sealing element is no longer in a compressed state directly underneath it. The packer then can easily be removed.

DETAILED DESCRIPTION OF THE PREFERRED EMBODIMENT

Figure 1A:
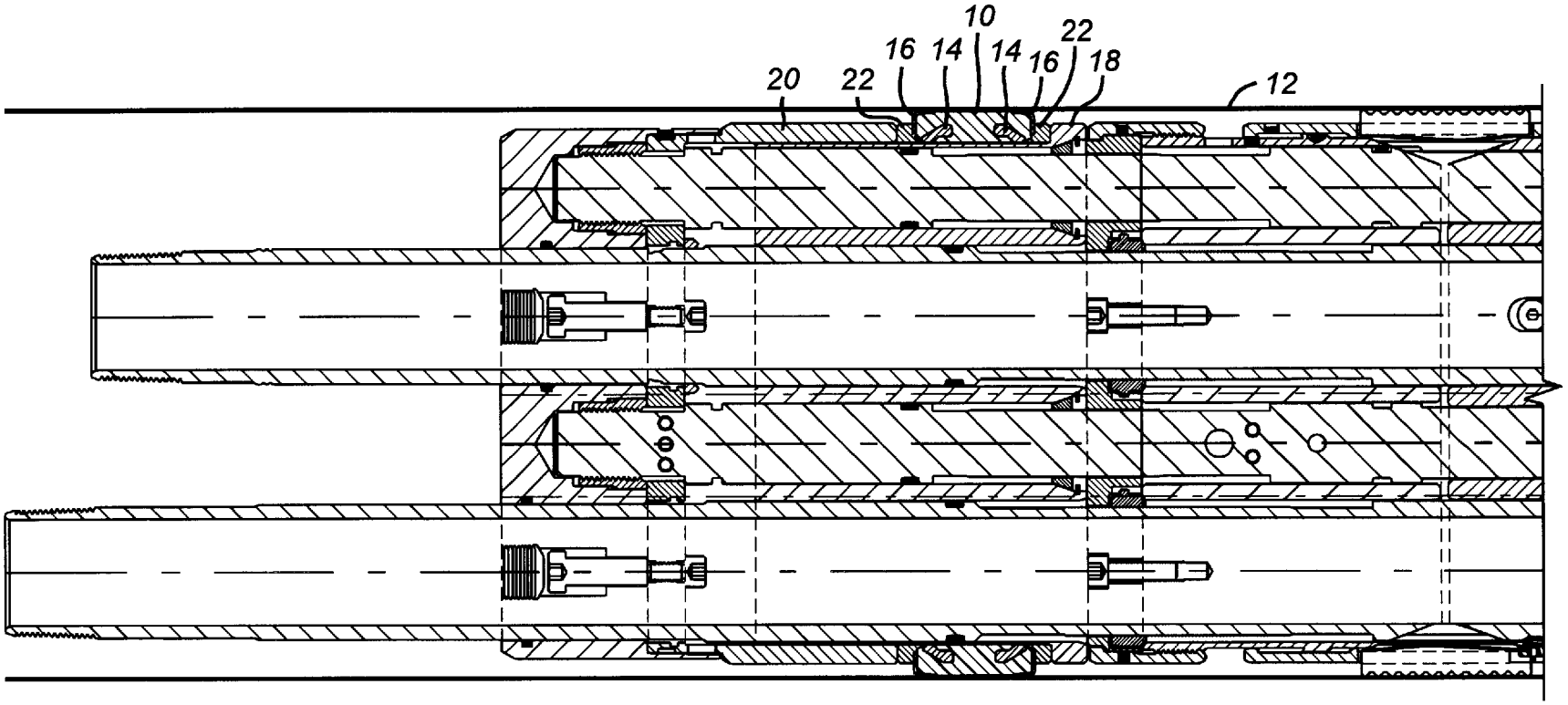
(PRIOR ART) FIG. 1a
FIGS. 1*a*–1*b* are an illustration of a dual-bore packer having unattached metal back-up rings as is known in the prior art.
Figure 1B:
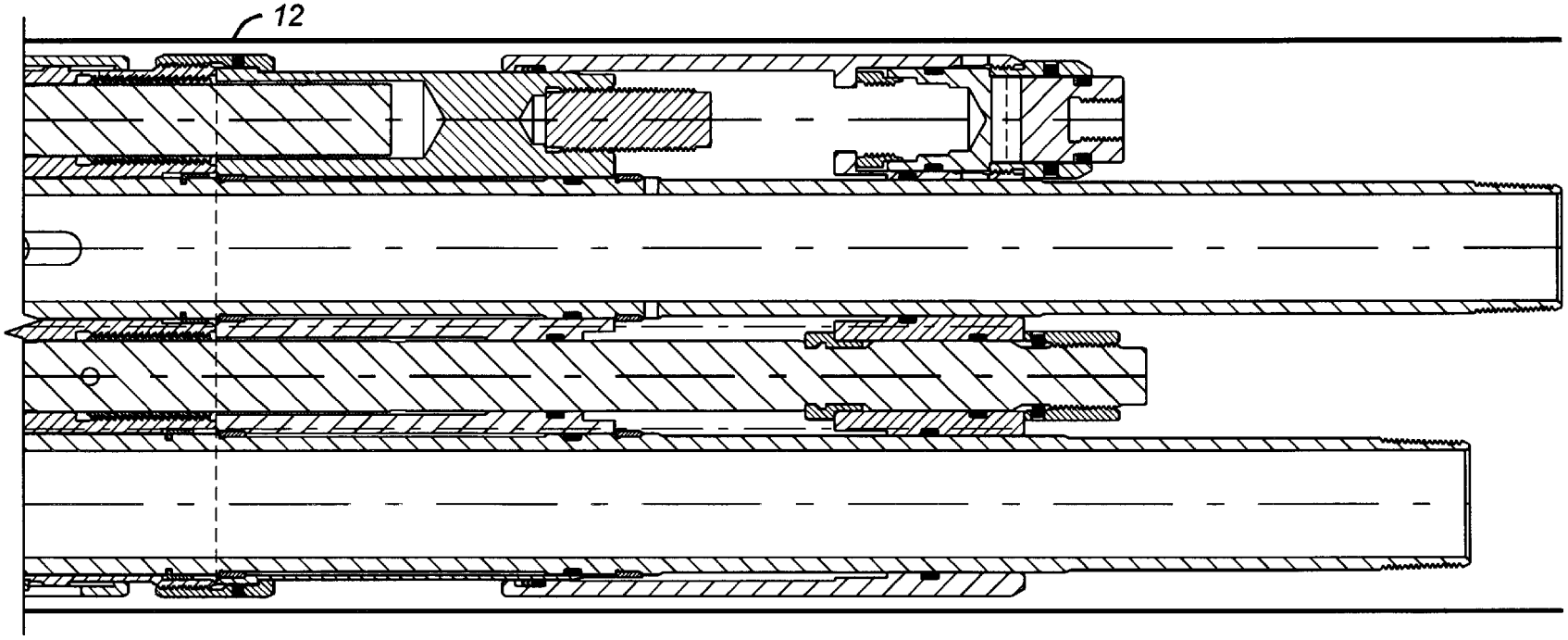
(PRIOR ART) FIG. 1b
Figure 2A:
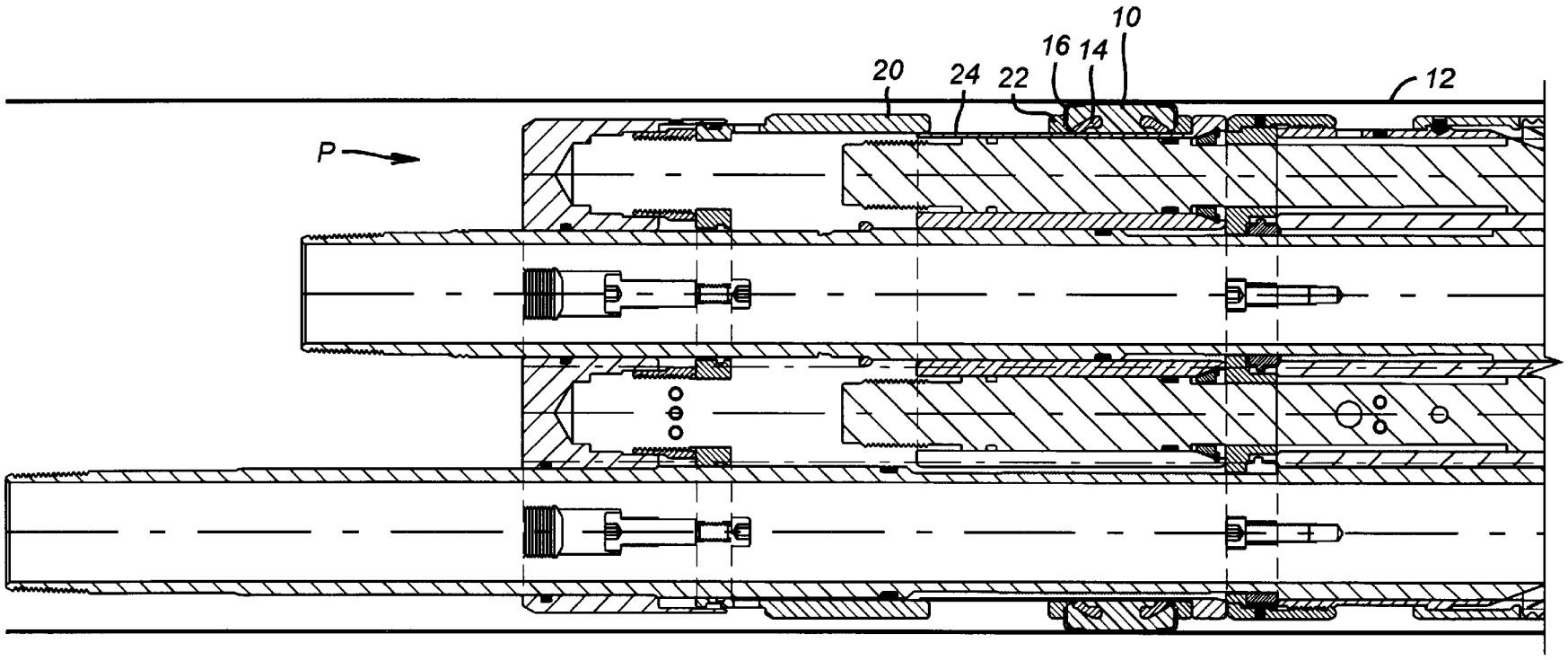
(PRIOR ART) FIG. 2a
FIGS. 2*a*–2*b*, are the packer of FIGS. 1*a*–1*b*, shown after an attempt to retrieve the packer has begun.
Figure 2B:
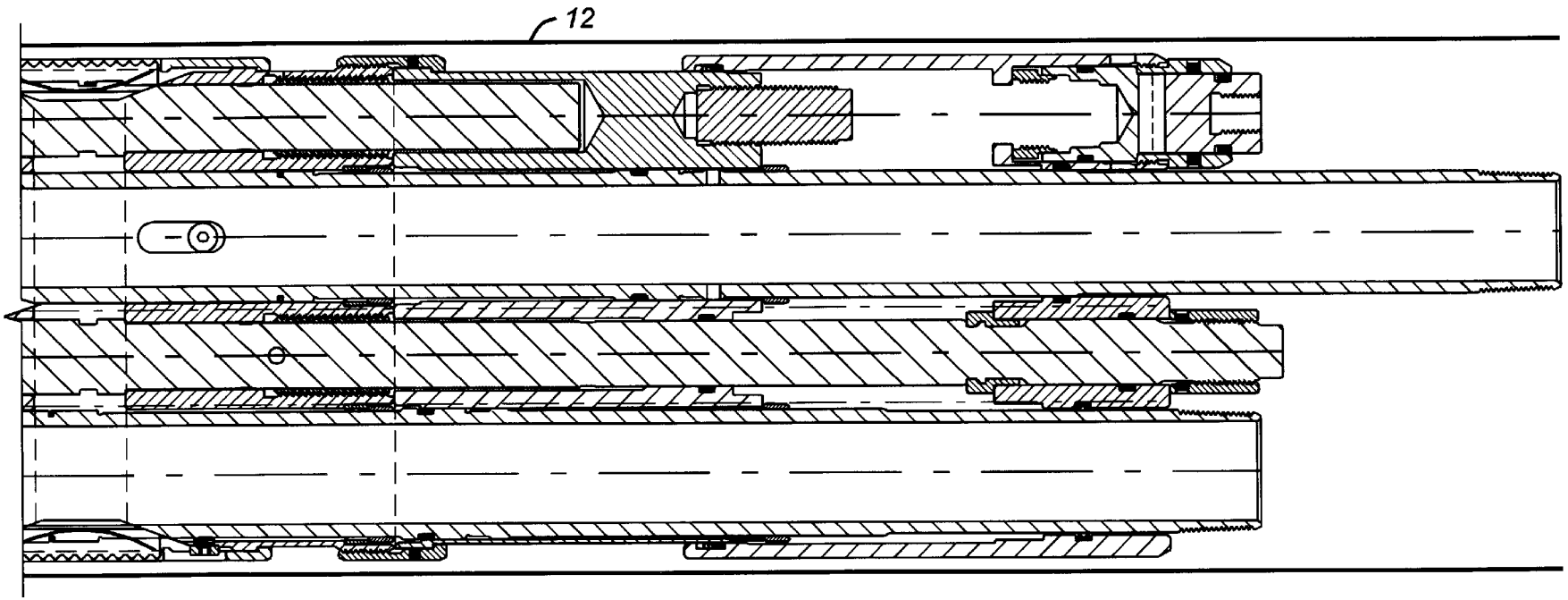
(PRIOR ART) FIG. 2b
Figure 3A:
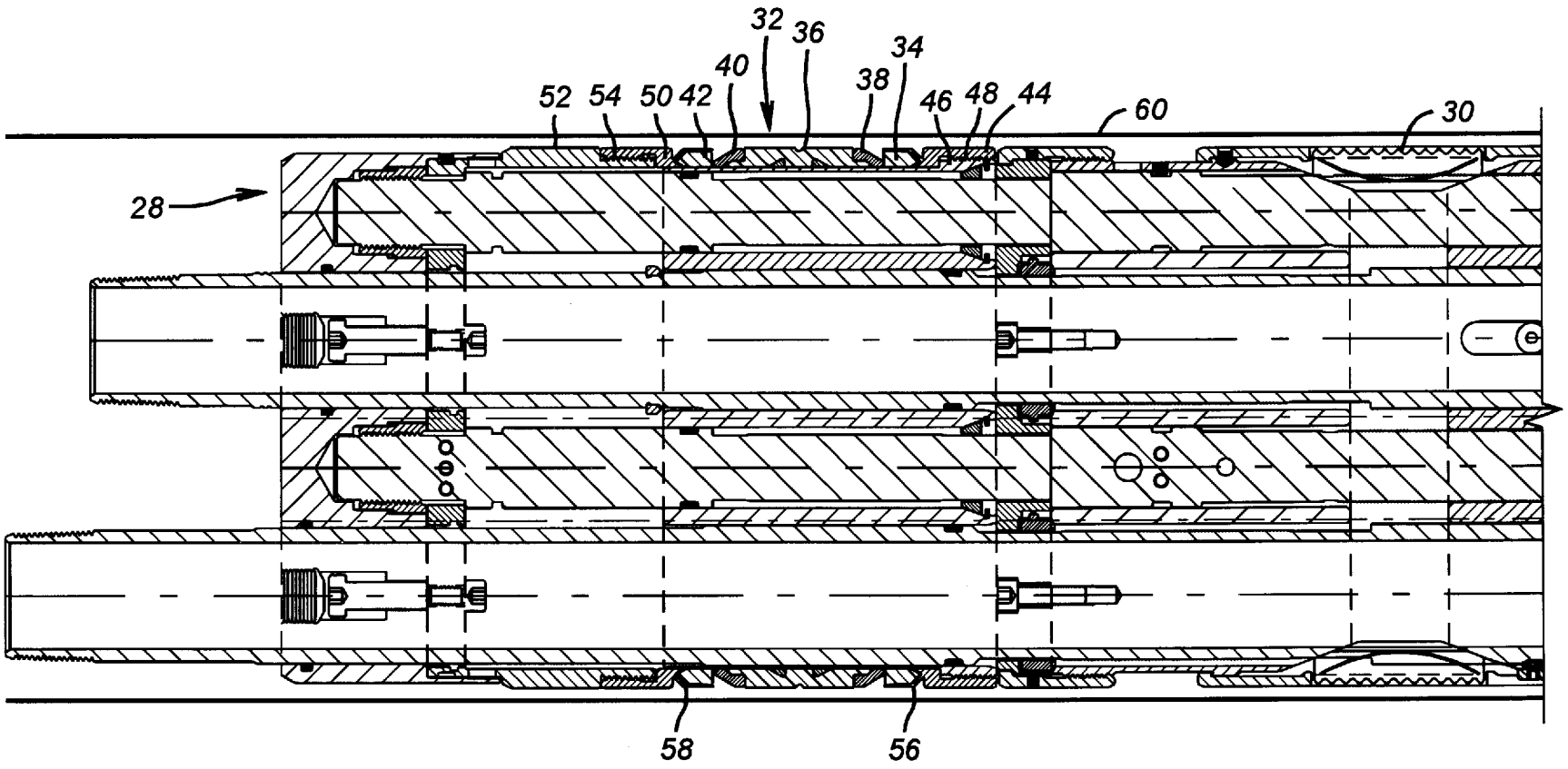
FIGS. 3*a*–3*b* are a sectional elevational view of a dual-bore packer in the run-in position, illustrating the attached back-up ring design.
Figure 3B:
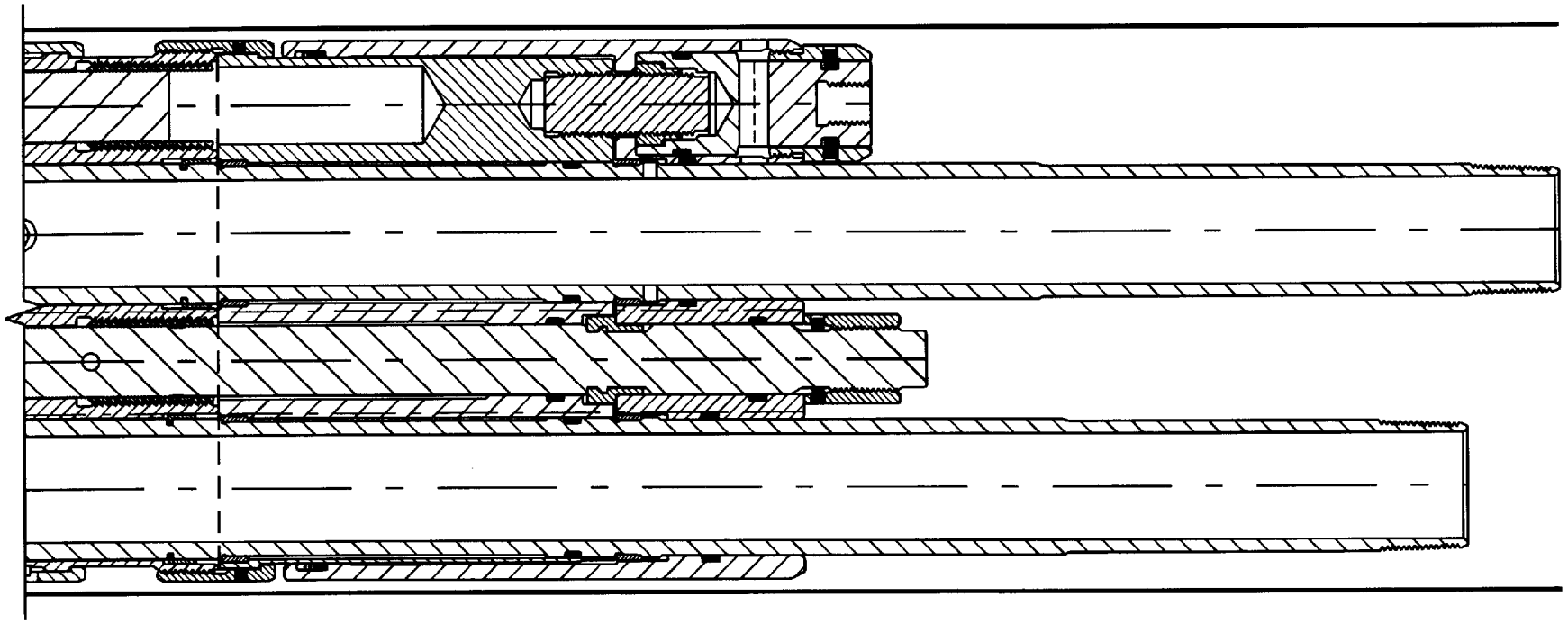

Referring to FIG. 3, a dual-bore packer is illustrated. The illustrated packer is dual bore; however, the invention as will be described can be adaptable to single bore, multiple bore, or bridge plugs, or any other downhole tools that employ seals. The packer 28 has slips 30 and a sealing element 32 which is made up of several components. The lowermost sealing element is 34. Element 34 is separated from the element 36 by separator 38. Separator 40 separates element 36 from element 42. Back-up ring 44 is physically connected to sleeve 46 at thread 48. Similarly, back-up ring 50 is connected to sleeve 52 at thread 54. Back-up rings 44 and 50 have a generally L-shaped component 56 and 58, respectively. The L-shaped component 56 conforms to the shape of sealing element 34 during run-in, while the L-shaped component 58 conforms to the shape of sealing element 42 during run-in.

Those skilled in the art will appreciate that until the packer 28 is ready to be set, the sleeves 52 and 44 are retained in their positions shown in FIG. 3*a*. Thus, even if there is significant fluid velocity past the sealing elements 34, 36, and 42, there is no tendency for the system of seals, as shown in FIG. 3*a*, to compress due to velocity effects because the lowermost sealing element 34 is shielded by the L-shaped segment 56 of back-up ring 44 which is, itself, retained to the sleeve 46 and thread 48. Accordingly, uphole velocities of fluids cannot drive the seal element 34 upwardly because it is, to some degree, retained or shielded at that point by the L-shaped segment 56. By the same token, the structure of the L-shaped segment 58 resists the tendency of the upper sealing element 42 to move outwardly in response to downhole velocities flowing past the sealing element 42. The middle portion during run-in has sufficient flexibility to slightly flex in response to uphole or downhole velocities without moving outwardly sufficiently so that it can become ensnared onto the casing 60. Any contact during run-in between any of the sealing elements and the casing 60 could result not only in tearing of the sealing elements, which would preclude holding pressure once the packer 28 is set, but even worse, it could result in the packer 28 becoming stuck, which would result in a milling operation to get it out of the way.

Figure 4A:
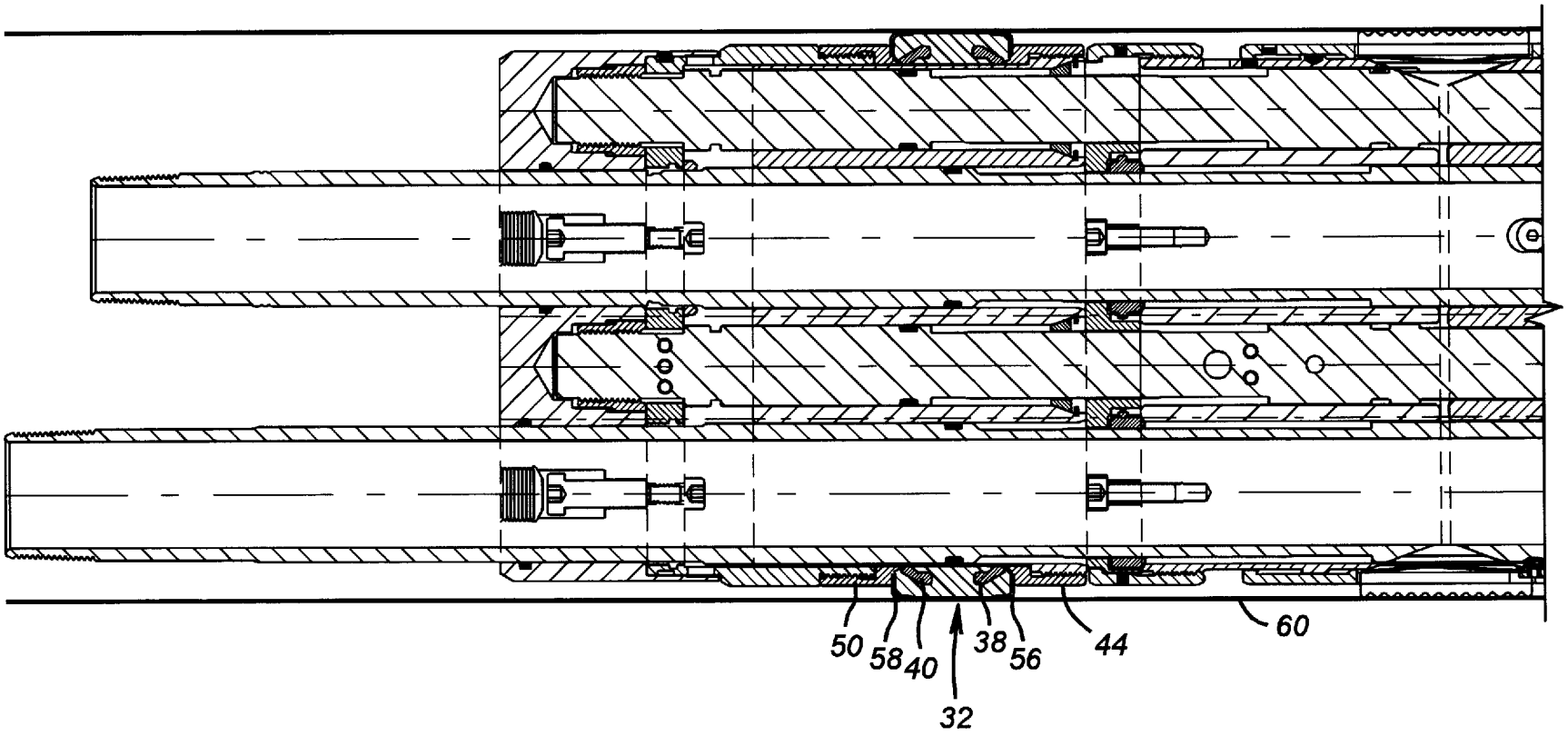
FIGS. 4*a*–4*b* are the view of FIGS. 3*a*–3*b* in the set position.

The packer 28 is shown in FIG. 4*a* in the set position. There, the various sealing elements 34, 36, and 42 are shown fully compressed together so that they appear as one solid, cohesive sealing element. The generally L-shaped members 56 and 58 that form generally obtuse angles in FIG. 3*a* now have been bent into more of a right angle, as shown in FIG. 4*a*. In this position, the back-up rings 44 and 50 serve their anti-extrusion purpose as they set flush against the casing 60, with the sealing system 32 compressed and pressed against the casing 60. The sealing system 32 also holds out the L-shaped portions 56 and 58 out against the casing wall 60, as illustrated in FIG. 4*a*.

Figure 5A:
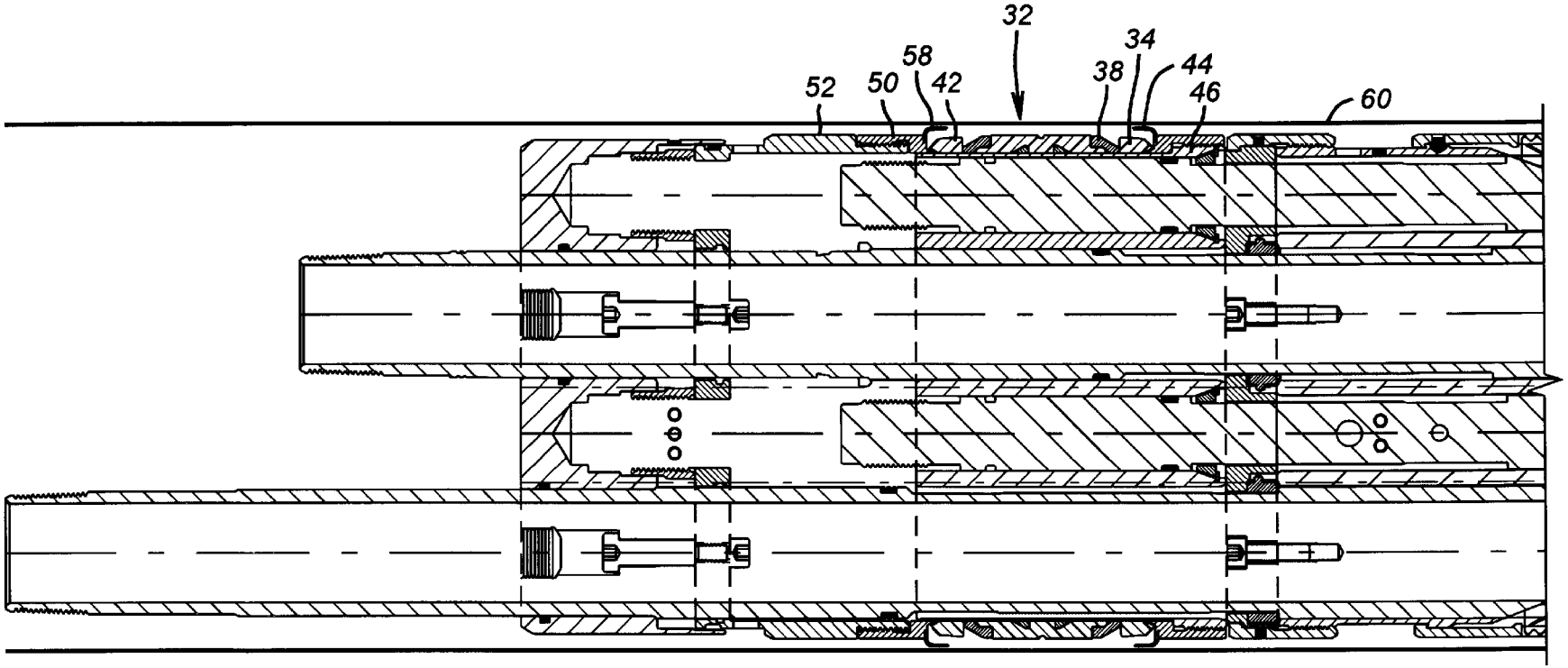
FIGS. 5*a*–5*b* are the packer shown in FIGS. 3 and 4 in the released position.

Referring now to FIG. 5*a*, the released position is illustrate where the upper back-up ring 50 has been pulled back due to movement of sleeve 52. The L-shaped segment 58 retains its same shape, but at this time the upper element 42 has relaxed, illustrating a gap between the L-shaped segment 58 and the upper sealing element 42. The same effect occurs at the opposite end as lower sealing element 34 is relaxed under L-shaped segment 56, creating a gap between itself and the L-shaped segment 56. Therefore, by moving sleeve 52 with respect to sleeve 46, the sealing elements 32 have fully relaxed in response to the uphole motion of sleeve 52. There is no longer a sealing system 32 in a compressed state pushing outwardly on the L-shaped segments 56 and 58. By allowing the sealing element system 32 to fully relax, an upward pull on the packer 28 is no longer met by resistance of the L-shaped segments 56 and 58 bearing against the casing 60, with the L-shaped segments being pushed against the casing 60 through the force of the sealing system 32. By using the apparatus of the present invention, and forcibly enlarging the spacing between the back-up rings 44 and 50, the packer or bridge plug 28 or other downhole device using a sealing system 32 can now be readily removed as the L-shaped segments 56 or 58, to the extent they encounter any internal obstructions on the trip up the hole, merely flex inwardly to allow removal from the wellbore. Accordingly, there is virtually no drag force holding the L-shaped segments 56 and 58 against the casing 60 on the trip up the hole.

Figure 6A:
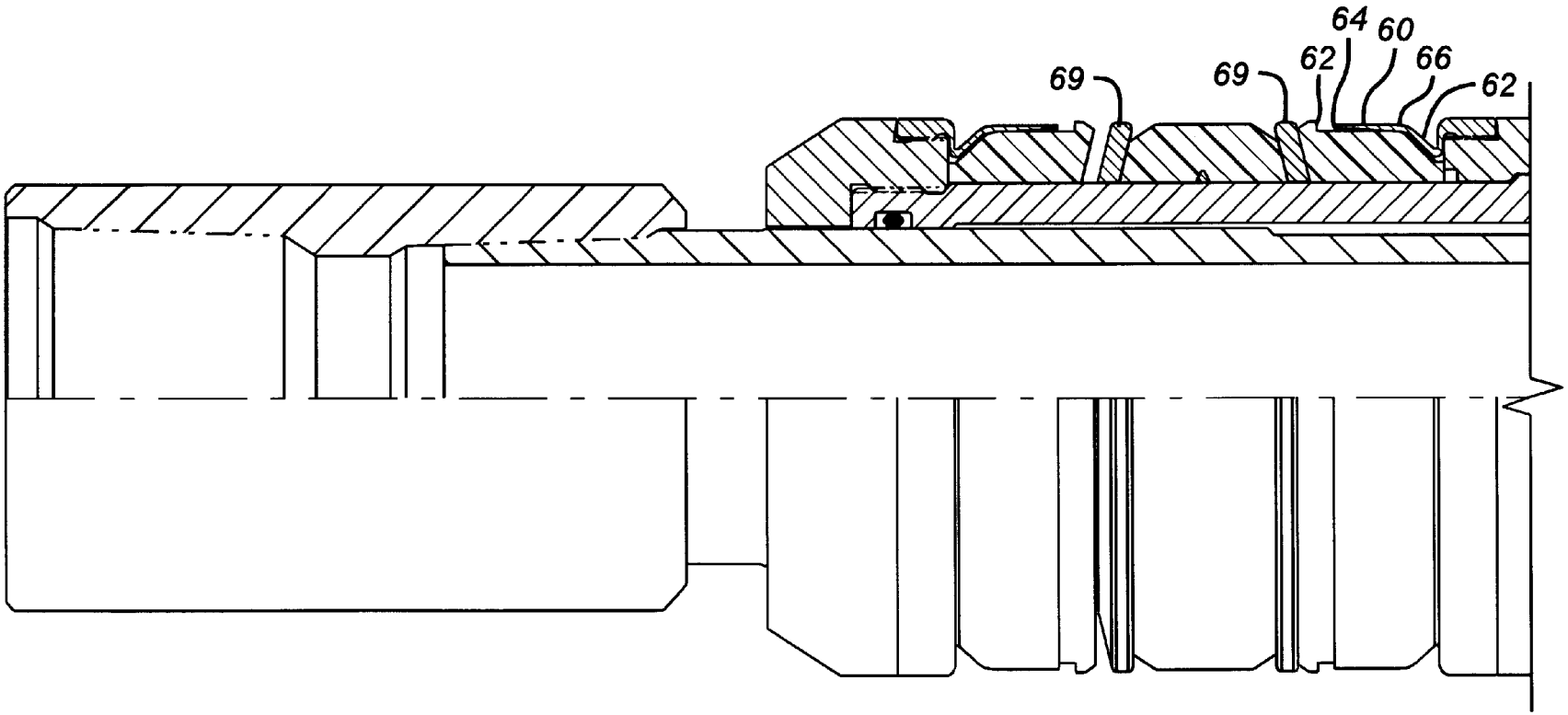
FIGS. 6*a*–6*c* are a single-bore packer, showing the attached metal back-up ring design in the run-in position.
Figure 6B:
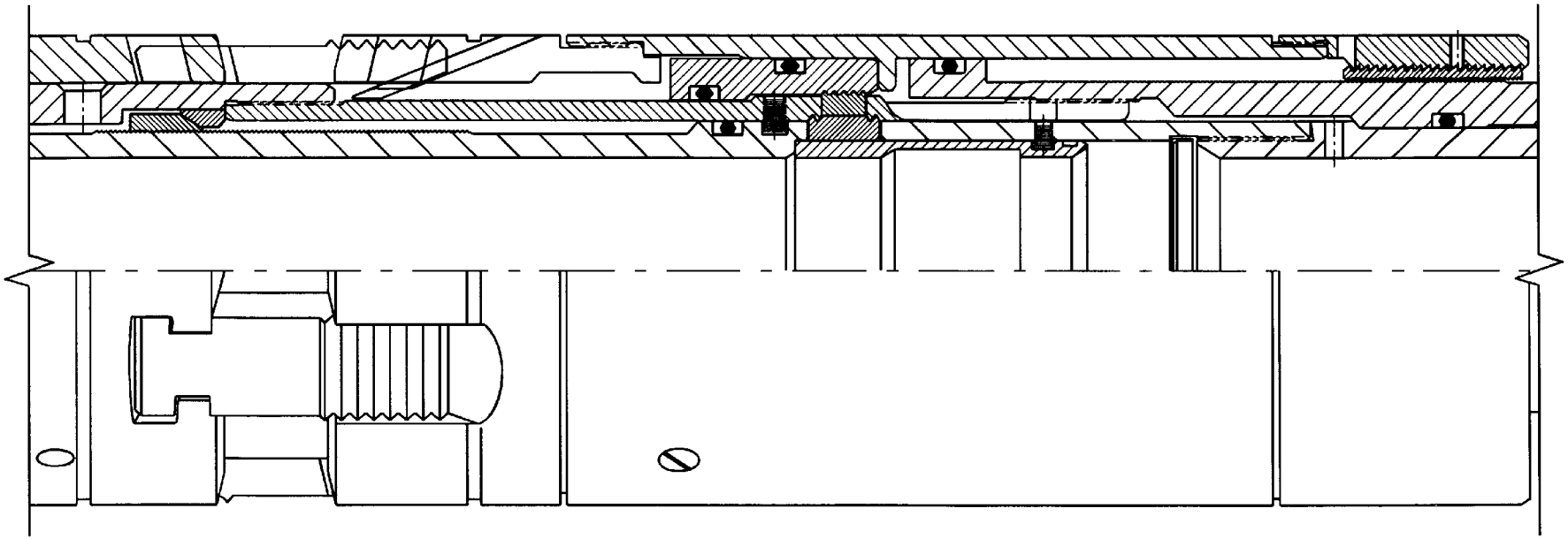
Figure 6C:
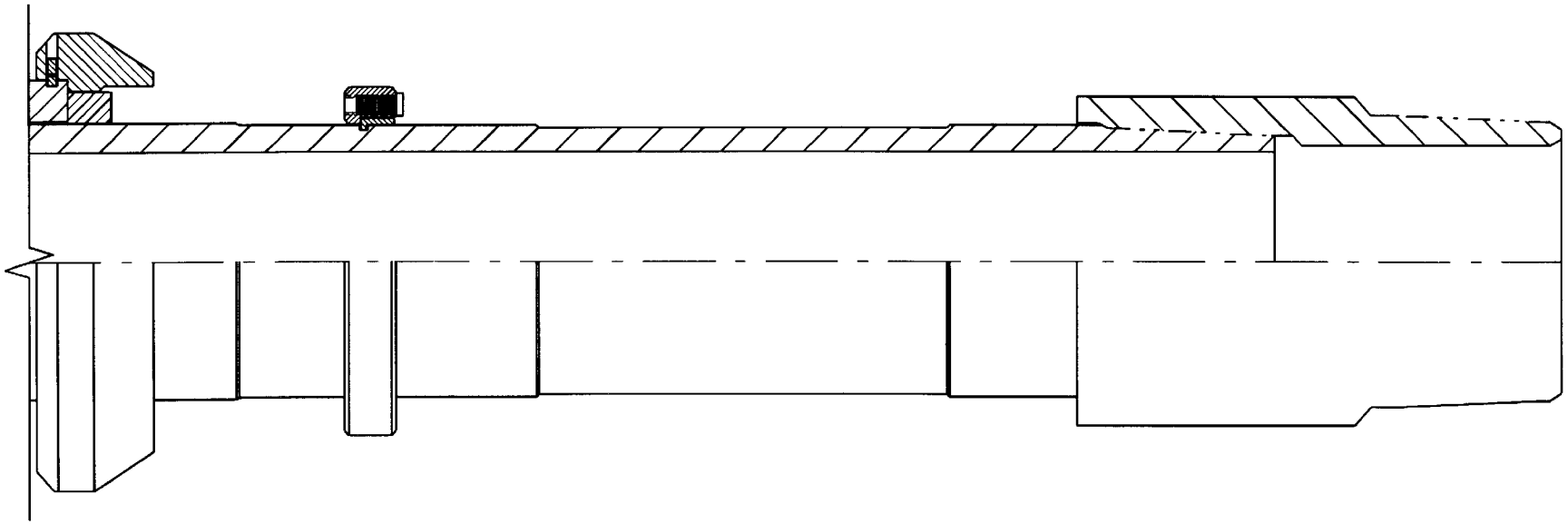

In view of the fact that a separate structure is used for the upper sealing element 42, as compared to the center sealing element 36 in the preferred embodiment, the back-up ring 50 can be easily pulled up, allowing the element 42 to separate from the element 36, which in turn allows the packer 28 to be pulled up the hole without any meaningful resistance from the back-up rings 44 or 50. Those skilled in the art will appreciate that the sealing system described above can be used on a wide variety of tools, including all types of packers, bridge plugs, and any other downhole tool that employs a sealing system. While a multi-element system has been described for sealing, sealing systems involving one or a multiplicity of elements can be used without departing from the spirit of the invention. The downhole tool can have one or more bores therethrough if it is a packer, or it can be a plug. The sealing elements can take a variety of shapes and still be within the purview of the invention. FIGS. 6*a*–6*c* show a single-bore, retrievable packer using the construction previously described. To facilitate the sealing in the embodiment shown in FIG. 6*a*, the lower sealing element 60 has a shoulder 62 which is eventually engaged by point 64 in the set position when the L-shaped segment 66 bends to accommodate the expansion of element 60. This facilitates the ability of the sealing system shown in FIG. 6*a* to resist extrusion when placed in the set position. The separators 69 are at an incline to better position the sealing elements to resist extrusion.

Figure 4B:
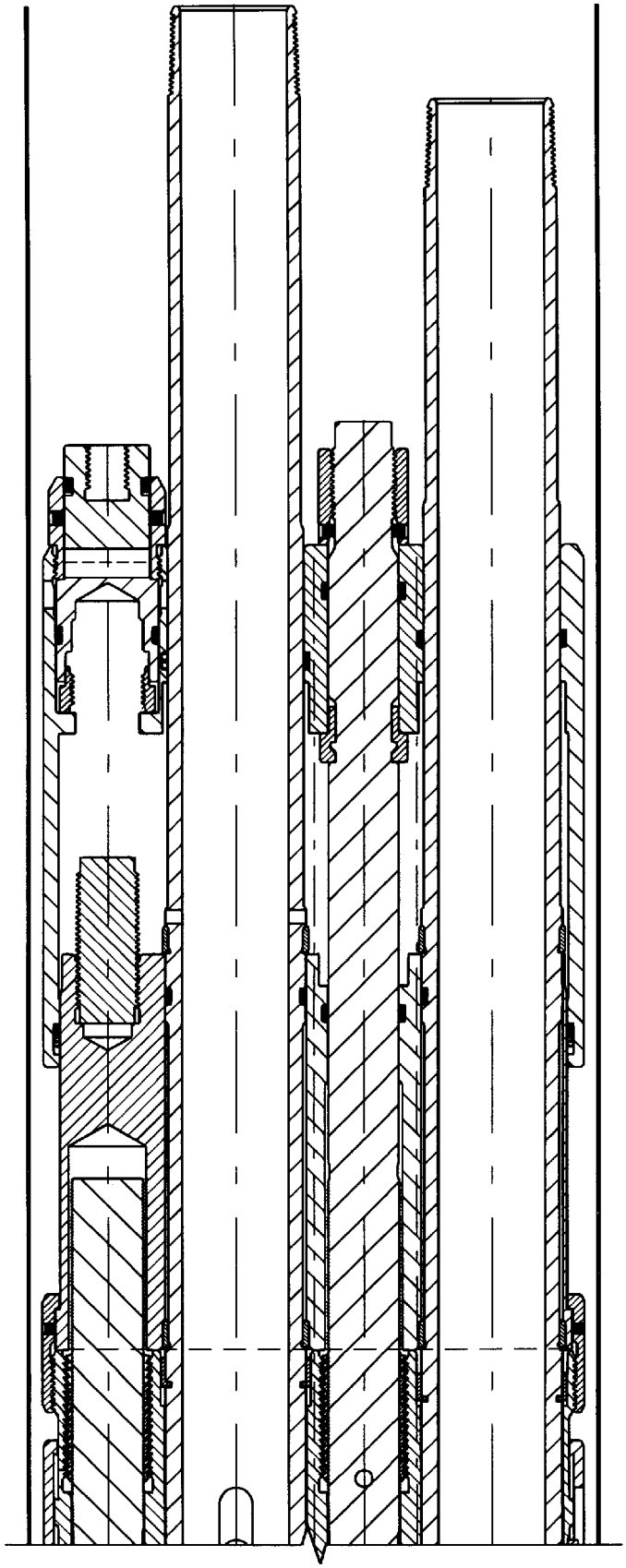
Figure 5B:
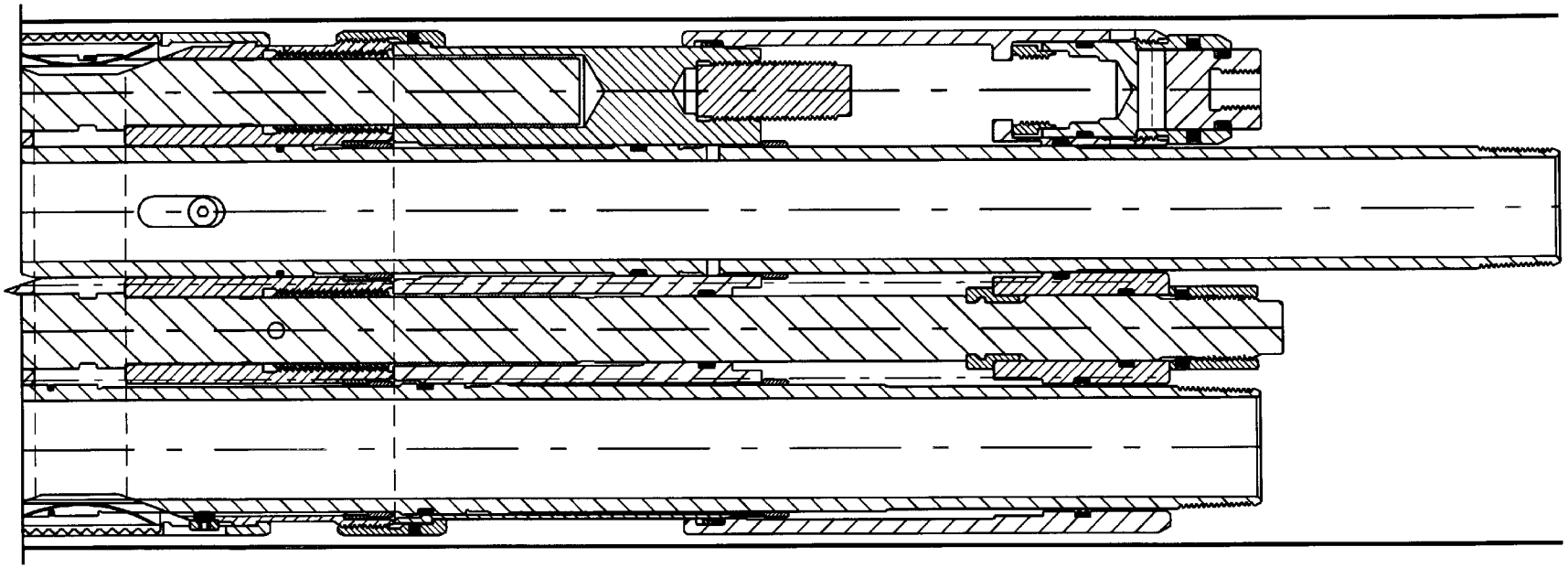

While the back-up rings, such as 50 and 44, have L-shaped segments 56 and 58, they generally conform to the run-in shape of the sealing elements. Such strict conformity is not required in that upon expansion, the sealing element system 32 fills any space below the L--shaped elements 56 and 58. However, in the preferred embodiment and to obtain the optimum results during run-in, it is preferred that there be a close conformity with the initial shape, such as shown in FIG. 6*a*, and the final shape of the bent elements, such as 66, which occurs on setting when angle 68 goes toward 0 degrees. In all other respects, the operation of the system shown in FIGS. 3–5 is the same as that shown in FIG. 6.

The foregoing disclosure and description of the invention are illustrative and explanatory thereof, and various changes in the size, shape and materials, as well as in the details of the illustrated construction, may be made without departing from the spirit of the invention.

We claim:

1. A sealing system for a downhole tool, comprising:

a body;

at least one sealing element on said body having an upper and lower end and movable between a relaxed and a set position;

two back-up rings disposed adjacent said upper and lower ends, at least one of which is selectively movable with respect to said body by a force applied to it to a position away from said sealing element when said sealing element is in said relaxed position to allow said sealing element to move away from the other said back-up ring;

said back-up rings being bent as said element moves toward its said set position and retaining said bent position as said element relaxes and loses contact with at least one of said back-up rings.

2. The system of claim 1, wherein:

said back-up ring is releasably secured to said body with said sealing element in said relaxed position for insertion of said body downhole.

3. The system of claim 2, wherein:

said back-up ring overlapping said sealing element when releasably secured to said body and, upon release, said back-up ring is movable away from said sealing element to allow said sealing element to move from said set to said relaxed position.

4. The system of claim 3, wherein:

upon release to move with respect to said body, said back-up ring is movable against said sealing element to move it toward said set position, whereupon said ring moves with said sealing element until its said set position is reached.

5. The system of claim 4, wherein:

said back-up ring flexes from a first position, when said sealing element is in a relaxed position, to a second position, when said sealing element is in said set position, said flexing occurring in conformance with the change in shape to said sealing element when said sealing element moves between said relaxed and set positions.

6. The system of claim 1, wherein:

said back-up ring comprises a substantially L-shaped segment which overlaps said sealing element when said sealing element is in said relaxed position and said body is run downhole;

said back-up ring is releasably secured to said body for the run downhole.

7. The system of claim 6, wherein:

said body comprises a movable sleeve;

said back-up ring connected to said sleeve;

said sleeve movable to force said back-up ring against said sealing element, whereupon said sealing element is compressed into its said set position and said back-up ring flexes in conformance with the change in shape of said sealing element as said sealing element moves to its said set position.

8. The system of claim 7, wherein:

said sleeve selectively movable with respect to said body to retract said back-up ring from said sealing element to a point where said back-up ring no longer overlaps said sealing element, whereupon said back-up ring can collapse toward said body if it encounters an obstruction upon removal from downhole and said sealing element can move from its set to its relaxed position due to said movement of said back-up ring.

9. A method of operating a downhole tool, comprising:

running in a tool which comprises a body having a predetermined diameter, a sealing element having an upper and lower end and mounted on the body, and two back-up rings on the body adjacent said upper and lower ends of said sealing element;

moving one of said back-up rings against said sealing element;

compressing said sealing element along said diameter with said movement of one of said back-up rings against the other of said back-up rings which remains stationary to seal around said body;

retracting one said back-up ring away from said element;

allowing said sealing element to relax; and removing said tool from downhole.

10. The method of claim 9, further comprising:

holding at least one said back-up ring in an overlapping position to said sealing element during run-in.

11. The method of claim 10, further comprising:

allowing said back-up rings to flex to conform to the change in shape of said sealing element when it is compressed.

12. The method of claim 11, further comprising:

creating a gap between said back-up rings and said sealing element by said retraction;

allowing said back-up ring adjacent said upper end of said seal room to flex toward said body and into said gap if an obstruction is encountered upon removal of said tool.

13. A method of operating a downhole tool, comprising:

running in a tool which comprises a body, a sealing element having an upper and lower end and mounted on the body, and two back-up rings on the body adjacent said upper and lower ends of said sealing element;

holding at least one said back-up ring in an overlapping position to said sealing element during run-in;

conforming the shape of a segment of said back-up rings to the relaxed shape of the adjacent said sealing element during run-in;

compressing said sealing element with said back-up rings to seal around said body;

allowing said back-up rings to flex to conform to the change in shape of said sealing element when it is compressed;

bending said segments as said sealing element is compressed;

using said segments as an anti-extrusion ring when said sealing element is abutting casing or tubing downhole;

retracting at least one said back-up ring away from said element;

creating a gap between said back-up rings and said sealing element by said retraction;

allowing said back-up ring adjacent said upper end of said seal room to flex toward said body and into said gap if an obstruction is encountered upon removal of said tool;

allowing said sealing element to relax; and removing said tool from downhole.

14. The method of claim 13, further comprising:

using a sleeve connected to at least one said back-up ring to retract said back-up ring in its bent condition away from said sealing element;

allowing said sealing element to relax as a result of said retraction of at least one said back-up ring.

15. The method of claim 14, further comprising:

using a plurality of sealing elements between said back-up rings.

* * * * *